US005421852A

United States Patent [19]

Maruyama et al.

[11] Patent Number: 5,421,852

[45] Date of Patent: Jun. 6, 1995

[54] HARD ALLOY AND ITS MANUFACTURING METHOD

[75] Inventors: Masao Maruyama; Hiroshi Nakagaki; Minori Shirane, all of Itami, Japan

[73] Assignee: Sumitomo Electric Industries, Ltd., Osaka, Japan

[21] Appl. No.: 969,816

[22] PCT Filed: Aug. 27, 1992

[86] PCT No.: PCT/JP92/01108

§ 371 Date: Jan. 25, 1993

§ 102(e) Date: Jan. 25, 1993

[87] PCT Pub. No.: WO93/05191

PCT Pub. Date: Mar. 18, 1993

[30] Foreign Application Priority Data

Sep. 2, 1991 [JP] Japan ..... 3-250437
Sep. 2, 1991 [JP] Japan ..... 3-250438
Feb. 24, 1992 [JP] Japan ..... 4-073557

[51] Int. Cl.[6] ..... C22C 29/02; B22F 3/14

[52] U.S. Cl. ..... 75/239; 75/240; 75/242; 419/14; 419/18; 419/23; 419/38; 419/49; 419/53; 419/54

[58] Field of Search ..... 75/238, 239, 240, 242; 419/13, 14, 18, 23, 38, 49, 54, 53

[56] References Cited

U.S. PATENT DOCUMENTS 3,451,791 6/1969 Meadows ..... 75/240
3,480,410 11/1969 Hummer ..... 75/240
3,746,519 7/1973 Hara et al. ..... 75/240
3,816,081 6/1974 Hale ..... 29/182.7
3,993,446 11/1976 Okawa ..... 75/240
4,013,460 3/1977 Brown et al. ..... 75/240
4,024,902 5/1977 Baum ..... 75/240
4,753,678 6/1988 Maruyama et al. ..... 75/238
4,923,812 5/1990 Timm et al. ..... 75/239
4,950,328 8/1990 Odani et al. ..... 75/240

FOREIGN PATENT DOCUMENTS 63-83236 4/1988 Japan .
1-219140 9/1989 Japan .
3-115541 5/1991 Japan .

*Primary Examiner*—Ngoclan T. Mai
*Attorney, Agent, or Firm*—Wenderoth, Lind & Ponack

[57] ABSTRACT

Disclosed is a hard alloy with high hardness, high abrasion resistance, high corrosion resistance and high rigidity, which is excellent in performance in use for tools. The hard alloy contains more than 80% by weight of WC with less than 2 μm of average particle size, more than 0.2% by weight and less than 2% by weight of Co and the remaining part of one or more metals, carbides, nitrides and carbonitrides of the metals in the IVa, Va and VIa families in the periodic table, such as 2.0 to 7.0% by weight of one or more of Mo and $Mo_2C$, and the alloy contains $Co_xW_yC_z$ in the sintered product. By the addition of Mo or $Mo_2C$ and VC the growth of particles in the hard phase is inhibited and at the same time the wettability of WC—Co is increased. As the result a sintered carbide with high hardness, high abrasion resistance, high corrosion resistance and high rigidity, which has excellent performance in use for the nozzles for high pressure water flow and for tools for cutting, sliding and drawing die can be obtained.

8 Claims, 3 Drawing Sheets

HARD ALLOY AND ITS MANUFACTURING METHOD

FIELD OF THE INVENTION

The present invention relates to a hard alloy with high hardness, high abrasion resistance, high corrosion resistance, non-magnetism and high rigidity, which has excellent performance for nozzles for high pressure water flow and for tools for cutting, sliding and drawing die.

PRIOR ART

For obtaining a hard alloy with high hardness, high abrasion resistance, high corrosion resistance, non-magnetism and high rigidity, which has excellent performance when used for a nozzle for high pressure water flow and for tools for cutting, sliding and drawing die, there have conventionally been available such improved ceramics as silicon carbide, silicon nitride and boron carbide. These ceramics may be obtained by pressing a powder of raw material into a finally desired shape and then sintering.

On the other hand, it has been known that hard alloys for making tools with fair abrasion resistance and excellent cutting performance are obtained from a hard phase consisting of carbides, nitrides and others of metal elements in the IVa, Va and VIa families and a binding phase of iron family metals. In particular, WC—Co type cemented carbides are most excellent in mechanical properties, and so they are useful in the fields of cutting tools and abrasion-resistant tools. A WC—Co type cemented carbides is obtained by drying and granulating a mixture of WC powder (hard phase) and Co powder (binding phase) and then pressing and sintering the product.

However, since ceramics are truly high in hardness but low in toughness, it is difficult to apply them to fields where mechanical impacts are frequent. It is also known that cemented carbides made of a hard phase of carbides and nitrides of metal elements in the IVa, Va and VIa families and a binding phase of iron family metals have limited hardness. This is because decreasing the amount of the binding phase for the sake of increasing hardness of the alloy lowers its toughness. Particularly when the amount of the binding phase in the alloy is less than 2% by weight, uniform dispersion of the binding phase over the surface of the hard phase of WC particles becomes very difficult with the result of extensive decrease of the toughness. In the ordinary cemented carbides the binding phase made of Co and other metals cannot be decreased to less than 2% by weight.

The assignee of the present invention previously filed Japanese Patent Application No. 250437/1991, which discloses that specified amounts of $Mo_2C$ and VC are added to a WC—Co mixture to prevent the wettability of WC—Co from being inhibited upon decreasing the amount of Co, and that selection of the particle size of WC and making conditions of sintering or HIPping optimum for the material in the employed amount of the binding phase make it possible to obtain a hard alloy composed of WC—$Mo_2C$—VC—Co with a small amount of the binding phase.

However, even in the above described hard alloy whose composition is 4 phases of WC—$Mo_2C$—VC—Co, as far as Co is present as a metal in the alloy playing a role of ordinary binding phase, there still exist limitations in the hardness and toughness similar to previous alloys. In addition, since there are considerable differences in such properties as the Young's modulus and hardness between the hard and binding phases, a large stress tends to exist at the interface impairing the toughness of the alloy.

DISCLOSURE OF THE INVENTION

Thus, a first objective of the present invention is to provide a hard alloy in which the hardness of the alloy is increased more than ever by using a small amount of the binding phase and yet lowering the toughness of the alloy is prevented.

A second objective of the present invention is to provide a cemented carbide with high density and high strength, in which the wettability of the hard phase containing WC as the major component and the binding phase is improved.

A third objective of the present invention is to provide a method of manufacturing the above cemented carbide with high density and high strength.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 2:
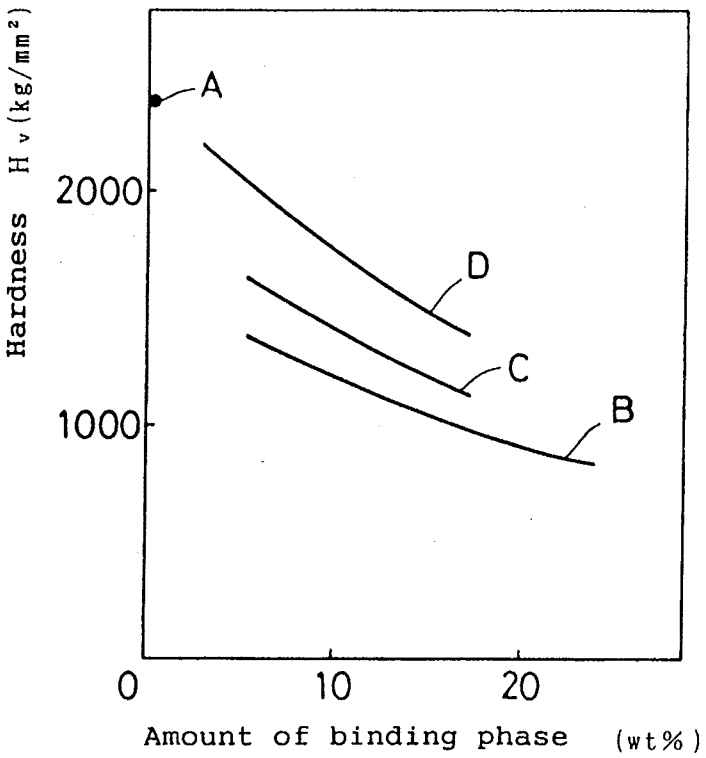
FIG. 2 shows the relation between the amount of the binding phase and the hardness for the sake of comparing an example of the present invention with the prior art.

The present invention has an objective to provide a material with specially high hardness and also high toughness and high abrasion resistance to be used for nozzles for high pressure water flow and for tools for cutting, sliding and drawing die. Since ceramics lack toughness they were excluded from our object of investigation, and we sought to achieve the above objective by improving the composition of cemented carbide.

Our first approach was to decrease extremely the amount of the binding phase in cemented carbide. Basically we used WC that had excellent toughness, strength and hardness as the major component in the hard phase, making it occupy more than 80% by weight in the hard sintered product. With less than 80% by weight of WC, a hard alloy with desired hardness, toughness and abrasion resistance could not be obtained.

In the fields of arts related to previous cemented carbide, those containing less than about 5% by weight of the binding phase could not be manufactured or were hardly utilized for the reason that even if they increased hardness they lacked toughness.

The inventors of the present invention decided to study the above reason and initiated the studies by examining the effect of decreasing the amount of Co that was thought to function as the binding phase to less than 2% by weight. Since the amount of the binding phase was small, it was thought that the components in the hard alloy were required to be the materials with good wettability to each other. In this sense addition of Mo or $Mo_2C$ was considered. It had not been known in what form these additives were present in the hard sintered product. However, because $Mo_2C$ was a relatively stable compound it was highly possible that all were present as $Mo_2C$.

A hard alloy obtained in this way was found to have improved strength as a sintered product in comparison with the alloy without the addition of the above additives. However, it was also found that the addition of less than 2% by weight of the additives gave insufficient effect while the addition of more than 7% by weight caused lowering of the hardness. It was considered that these additives were also effective for improving the wettability of WC and the binding phase.

However, the above composition did not stabilize the density of hard alloy, and accordingly the characteristics of the hard alloys thus manufactured were unstable. Preliminary experiments were conducted for elucidating the cause. Results of preliminary experiments showed that there existed a close relation between the particle size and the density of the sintered product. Studies on this effect in more detail gave results which are summarized in FIG. 1. Thus, making the average particle size of WC in hard alloy less than 2 μm gave hard sintered product with high density. When the average particle size of WC was made to be about 1.0 μm the density was nearly 100%.

The important point, accordingly, is to keep the particle size of WC in sintered product less than 2 μm, but generally the particle size of WC fluctuated depending on the conditions of sintering. When the temperature of sintering was high or the time of sintering was long, the particle size of WC tended to become larger. It was also natural that the particle size of WC in the powder of raw materials and its particle size distribution influenced the particle size of WC in the sintered product.

Accordingly the particle size of WC in the sintered product was extremely unstable, and it was found clearly that one of the most important factors for achieving the objective of the present invention was how to regulate the particle size in the sintered product.

In practically used cemented carbides, VC and chromium carbide have been well known as the agents inhibiting the growth of WC particles. However, it was not clear whether such a previous common knowledge was valid in the present invention in which a minute amount of the binding phase was used for manufacturing a cemented carbide.

In the previous techniques of manufacturing cemented carbides, Co is considered to be molten during sintering in which WC is dissolved and then precipitated again. In these processes chromium carbide and VC work to inhibit the growth of WC particles. As in the present invention in which less than 2% by weight of Co, the binding phase, is employed, the mechanism of sintering has not been known.

Without certain prospect of the results to be obtained, the present inventors started to investigate the effects of VC and chromium carbide in different amounts. From the results it was found that the presence of 0.2 to 0.6% by weight of VC or chromium carbide in the sintered product was greatly effective. The effect was not obtained with less than 0.2% by weight and when the amount was more than 0.6% by weight the degree of sintering was extremely deteriorated.

Although using a minute amount of the binding phase, for obtaining a cemented carbide with higher hardness it was desirable to use 0.2 to 1.0% by weight of Co as the binding phase. However, due to too small an amount of the binding phase defects in considerable amounts may occur in the hard sintered product. In manufacturing procedures employment of the HIP treatment is effective to destroy the alloy defects, but the effect of HIP is not obtained unless the alloy before the HIP treatment is in a normal or near normal state. For obtaining normal alloy after the HIP treatment it is required that the alloy has at least higher than 98% of density before the treatment. This is probably due to the fact that when the density is too low, defective pores in the alloy link to some degrees to the surface, and the pressure of HIP affects into the interior of the pores so that they cannot be destroyed.

It was also found that the addition of the carbides, nitrides and carbonitrides of the metals in the IVa, Va and VIa families in the periodic table revealed similar effects as did the present invention. When the amount of carbon is short in hard sintered product, there may occur $W_2C$ but it will not give undesirable effects in particular.

Figure 4:
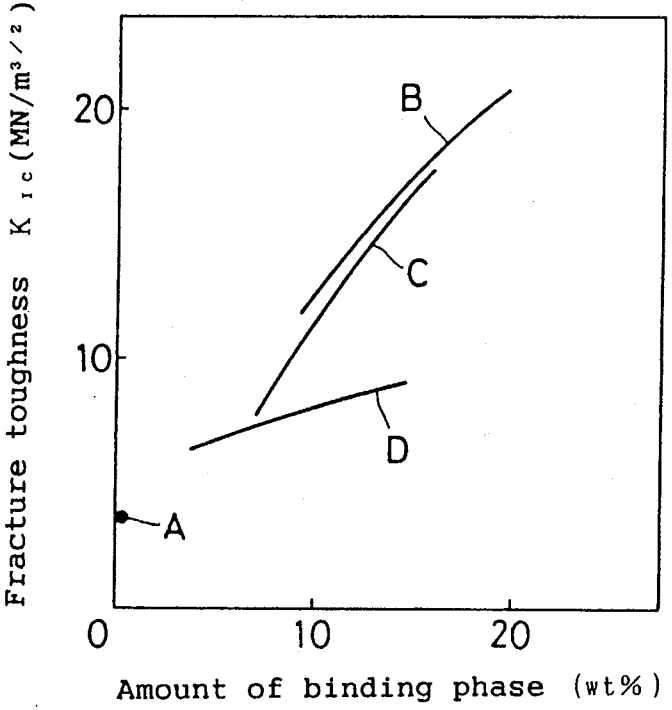
FIG. 4 shows the relation between the amount of the binding phase and the fracture toughness for the sake of comparing an example of the present invention with the prior art.
Figure 3:
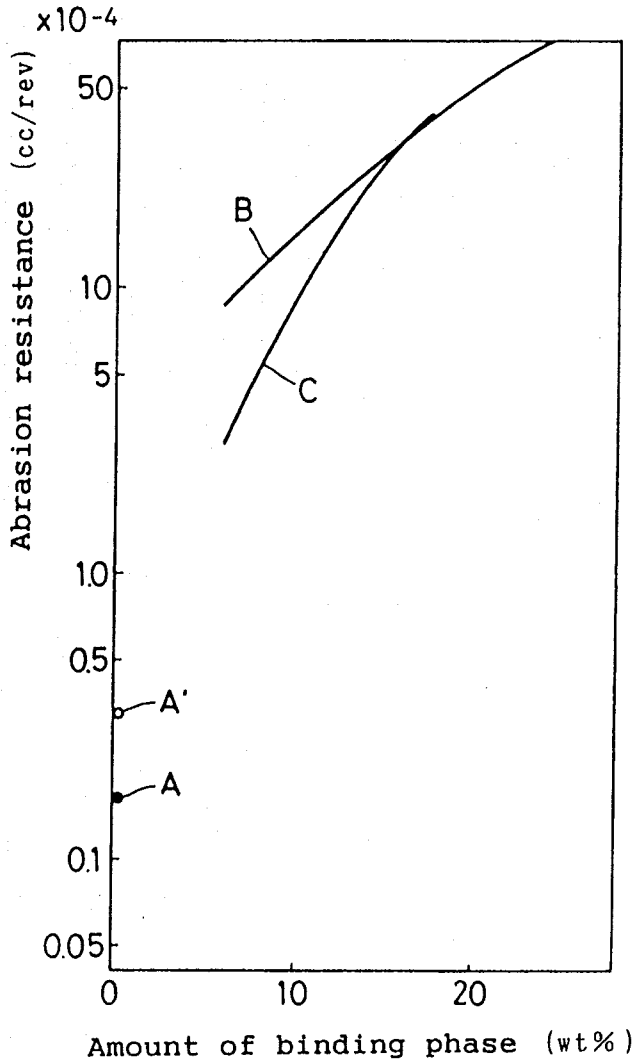
FIG. 3 shows the relation between the amount of the binding phase and the abrasion resistance for the sake of comparing an example of the present invention with the prior art.

The hard alloys obtained in this way have, as shown in FIGS. 2 to 4, high hardness and so high fracture toughness values as practically usable and excellent abrasion resistance.

Figure 5:
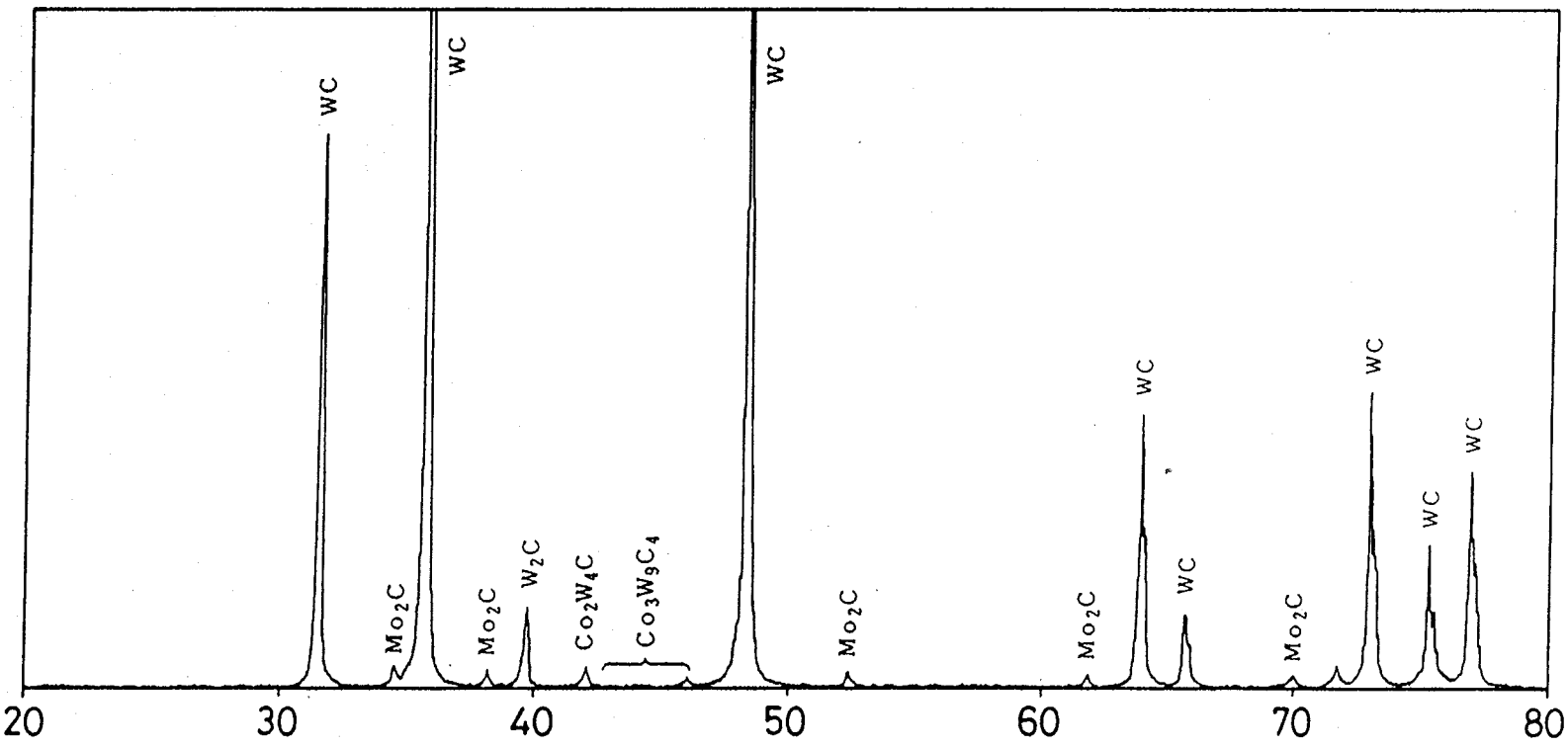
FIG. 5 shows X-ray diffraction of the hard alloy of sample No. 3 in Example 1 of the present invention.

The inventors of the present invention examined a hard alloy with particularly excellent abrasion resistance among other ones by X-ray diffraction analysis. An example is shown in FIG. 5. The findings obtained here are so unexpected that there are present peaks assumed to be due to $Co_2W_4C$ and $W_2C$ together with the peaks for WC. In the hard alloy of the present invention, sintering proceeds ordinarily in liquid phase, as described before. Accordingly, in the processes of dissolving WC in the liquid phase of Co and then precipitating again, the nature of the precipitated substance will be different depending on whether the amount of C is too little or too much. From this point of view a variety of sintered products were prepared and the phases in the hard sintered products were studied.

The results were so astonishing that such various intermetallic compounds assumed to be $Co_3W_9C_4$, $Co_3W_3C_1$, $Co_6W_6C_1$ and $Co_3W_4C_1$ were present.

Intermetallic compound $Co_xW_yC_z$ has higher hardness than WC and Co and contributes to improve the hardness of alloys, but, on the other hand, it has lower toughness than Co which is the ordinary binding phase, and it is fragile in single. Since the intermetallic compound $Co_xW_yC_z$ shows low toughness in a large micro structure, it is possible to suppress lowering of toughness of alloy as extensively as possible by making it separate minutely.

The presently known (x, y, z) in $Co_xW_yC_z$ are (3, 9, 4), (3, 3, 1), (6, 6, 1) and (2, 4, 1) and all of them have the above described effects.

$Mo_2C$ or Mo in the alloy reacts with free carbon in the raw material of WC powder: ($aWC+bC+cMo_2C$ (or Mo)$\rightarrow a'WC+dMo_2C+eMo$); this reaction improves the wettability of the hard phase and binding phase. The addition of VC into the composition of alloy can suppress the growth of WC particles during the liquid phase sintering process thereby achieving affording the alloy with higher density. On the other hand, the addition of Mo in the absence of free carbon causes partial decomposition of WC to form $W_2C$ and $Mo_2C$.

In case where the Co content of alloy is less than 1% by weight, namely in the so-called pseudo-binderless, cemented carbide, the presence of the above $Co_xW_yC_z$ further improves the hardness of the alloy, and since $Co_xW_yC_z$ has good wettability with the hard phase and precipitation of $Co_xW_yC_z$ as minute microstructure can prevent lowering of toughness of the alloy, there can be obtained a normal alloy.

There is a range of proper particle sizes of WC, and too large sizes will cause too large distances between particles requiring a larger amount of the binding phase for obtaining normal, poreless alloy. In pseudo-binderless cemented carbide containing an extremely small amount of the binding phase, therefore, large WC particles will allow many pores to occur in the alloy. Thus, the particle size of WC is desirable to be about 0.5 to 3.0 μm.

On the other hand, in case where the HIP treatment is needed for destroying pores in the sintered product, the presence of too many pores in the alloy with too low density before the HIP treatment indicates that some pores are linked to the surface, and the pressure of the HIP dissipates into the interior of the pores also so that the pores cannot be destroyed. Accordingly, the alloy is required to hold some high degree of density before the HIP treatment. The sintered products obtained desirably to show higher than 98% of the theoretical density before the HIP treatment.

The present invention uses WC, Co, Mo or $Mo_2C$ and VC as powdered raw materials as described before.

WC constitutes the major part of the hard phase and contains a minute amount of Cr and V as impurities. For example, a powder of 93.87% by weight of W powder is mixed with 6.13% by weight of C powder, and the mixture is carbonized in a carbonizing furnace under a non-oxidizing atmosphere to obtain a WC powder with less than 2 μm of particle size, which is used as a material.

Co employed as the binding metal is formulated in a low rate of 0.4% by weight. Since Cr and V are present only in amounts of minor impurities in the above WC powder giving only small amount of stable oxidized compounds, using such a decreased amount of Co as above will not deteriorate the wettability between WC and Co.

Decreasing the amount of Co from the above level makes free carbon appear more readily, in addition to WC ($\alpha$ phase)$-\gamma$(the Co phase containing W) in the alloy. This appearance causes lowering of hardness and strength of the alloy. For the prevention of this effect Mo or $Mo_2C$ is formulated in an amount of 5.5% by weight. This Mo or $Mo_2C$ mostly combines with free carbon in the powdered raw material.

The addition of Cr and V in such amounts as to be minor impurities to the WC powder during manufacturing the powder is profitable in that occurrence of stable oxides can be inhibited, but it makes the particles more readily grow in the hard phase (WC) during liquid phase sintering. To suppress this 0.4% by weight of VC is formulated. By the action of VC the growth of particles can be suppressed and the alloy can be made to have higher density.

An example of the manufacturing of the cemented carbide of the present invention is explained as follows. A powdered raw material consisting of the above WC, Co, Mo or $Mo_2C$ and VC is mixed thoroughly in a commercial ball-mill wet mixer. The mixture is dried, granulated and pressed, and after a preliminary sintering under definite conditions, it is subjected to hot isostatic press sintering (HIP) at a temperature higher than a temperature at which the liquid phase appears under high pressure (higher than 50 kg/cm$^2$) in an inert gas atmosphere to obtain the product.

The adequate conditions of the preliminary sintering are in vacuum or in a special atmosphere and at 1300° C. to 1600° C.×1 hr, and the sintering by hot isostatic press is adequately conducted in such an inert atmosphere of argon and other gases, under the pressure higher than 80 kg/cm$^2$ and at 1300° C. to 1600° C.×1 hr. The preliminary sintering and the hot isostatic press sintering may be done in a same procedure. Thus, in the same furnace the preliminary sintering and hot isostatic press sintering are carried out in succession. This simplifies the manufacturing procedure and at the same time it is profitable in that deformation of the surface of the sintered product due to transfer in and out of the furnace may be avoided.

The alloy obtained by the above manufacturing procedures shows the range of composition of cemented carbide as follows: Co, 0.2 to 1.0% by weight; Mo or $Mo_2C$, 2.0 to 7.0% by weight; VC, 0.2 to 0.6% by weight; and the remainder is WC. In case where Co is contained in the above composition in less than 0.2% by weight, there often occurs heterogeneous wettability over the surface of the hard phase causing prominent segregation. As the result it produces inferior characteristics of the alloy. By contrast when Co is contained in more than 2.0% by weight the Co phase spreads in homogeneous wettability over the surface of the hard phase, but the characteristic properties of the Co phase remain in the product of alloy. When Mo or $Mo_2C$ in the above composition is less than 2.0% by weight, it will react with free carbon (F.C.) present in the WC powder used, and wettability of the Co phase to the hard phase is not promoted by subsequent formation of $Mo_2C$ and/or the reaction of $aWC+bC+cMo\rightarrow a'WC+dMo_2C+eMo$, causing segregation of Co in the alloy. When Mo or $Mo_2C$ is contained in more than 7% by weight, however, the characteristic properties of Mo or $Mo_2C$ influence greatly the characteristics of the alloy giving lowered hardness. When the content of VC is less than 0.2% by weight, the wettability between VC and Co and the hard phase is not satisfactory causing segregation, and the effect to suppress the growth of WC particles is lowered allowing WC to grow. By contrast when VC is contained in more than 0.6% by weight, the characteristic properties of VC greatly influence those of the alloy (lowering of alloy hardness and so forth), and through the formation of intermetallic compounds with other elements and their precipitation there ensues lowering of toughness of the alloy.

A cemented carbide obtained in this way showed higher than 14.8 g/cm$^2$ of density, higher than 2300 kg/mm$^2$ of Vickers hardness and higher than 3.0 of fracture toughness value.

The porosity of the above alloy is less than A06, B06 or C02 in the ASTM Standard. This requirement of the ASTM Standard is due to shorter than 10 μm of pore size in class A and to longer than 10 μm and shorter than 25 μm of it in class B and to free carbon in class C. A06 corresponds to 0.2% (vol.) based on 200-fold magnified observation under microscope while B06 0.2% (vol.) (1300 pores/cm$^2$ ) based on 100-fold magnified observation under microscope.

DETAILED DESCRIPTION OF THE PREFERRED EMBODIMENTS

Below are examples of the present invention for more detailed description.

EXAMPLE 1

The components whose amounts (% by weight) are shown in Table 1 were mixed thoroughly in a ball mill for about 8 hours to obtain powdered raw materials. WC here employed had an average particle size of 1.5 μm. The powder materials were dried, granulated and subjected to pressing under a pressure of 1.0 T/cm$^2$, and after preliminary sintering at 1470° C. for about 1 hour they were subjected to hot isostatic press sintering (HIP) at 1320° C. under a high pressure of 1000 kg/cm$^2$ in an atmosphere of argon gas for 1 hour to obtain hard alloys.

The characteristics of these alloys are shown also in Table 1. The samples Nos. 6 and 7 are comparative ones made by the procedures outside of the present invention.

TABLE 1

| Sample No. | WC, wt % | $Mo_2C$ or Mo, wt % | Co, wt % | VC or $Cr_3C_2$, wt % | Density, % | Hardness $H_v$, kg/mm$_2$ | Fracture toughness $K_{IC}$, MN/m$^{3/2}$ |
|---|---|---|---|---|---|---|---|
| Example | | | | | | | |
| 1 | 98.5 | — | 1.5 | — | 98.5 | 2000 | 1.5 |
| 2 | 94.5 | 4.0* | 1.5 | — | 98.8 | 2200 | 2.0 |
| 3 | 94.5 | 4.0 | 0.9 | 0.6$^O$ | 99.5 | 2300 | 2.5 |
| 4 | 94.0 | 6.0 | 0.5 | 0.5 | 99.9 | 2400 | 4.0 |
| 5 | 91.5 | 7.0 | 0.9 | 0.6 | 99.5 | 2300 | 3.0 |
| Comparative Example | | | | | | | |
| 6 | 88.5 | 10.0 | 1.0 | 0.5 | 98.5 | 2000 | 1.0 |
| 7 | 97.5 | — | 2.5 | — | 98.0 | 1900 | 0.5 |

*MO
$^O Cr_3C_2$

EXAMPLE 2

The so-called pseudo-binderless, cemented carbides were manufactured by procedures similar to those described in Example 1, by employing WC with 5 different particles sizes of 0.7, 1.0, 2, 3 and 4 μm and less than 0.8% by weight of the binding phase.

Figure 1:
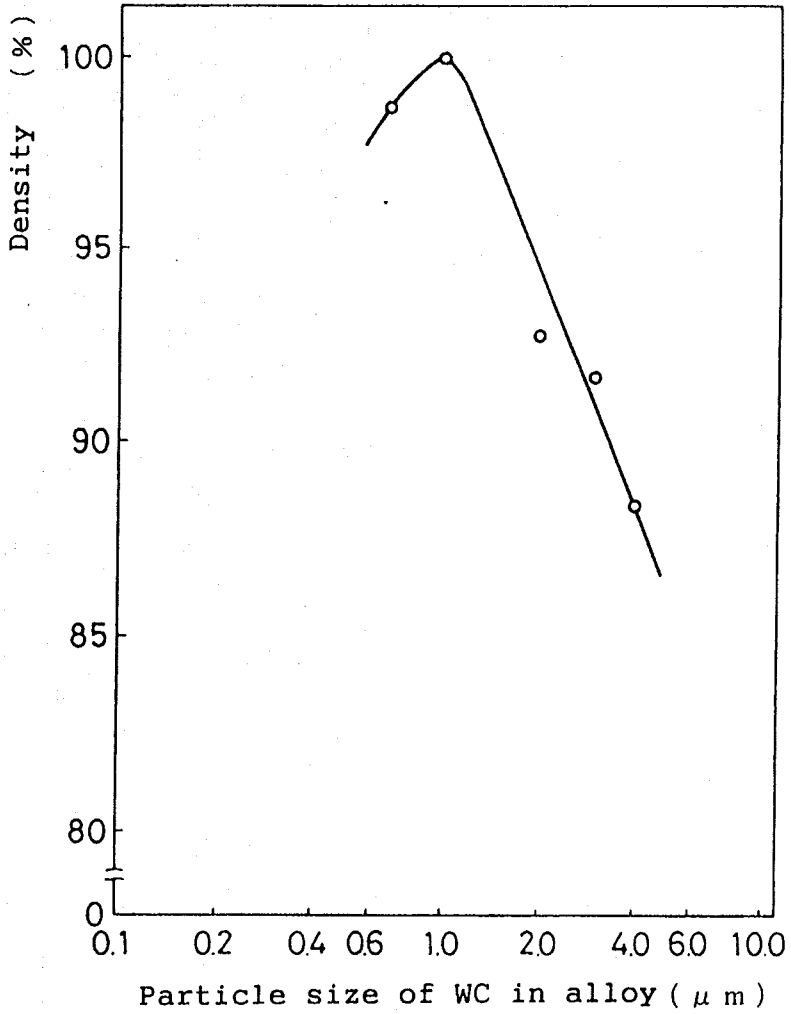
FIG. 1 shows the relation between the particle size of WC, the raw material, and the density of alloy in an example of the present invention.

The densities of the alloys thus obtained are shown in FIG. 1 in correspondence to the particle sizes of WC. The alloy density varied depending on the particle size of WC and it was found to be highest at a size of 1.0 μm.

FIG. 2 shows comparison of the hardness of the pseudo-binderless alloy of this Example with those of ordinary WC—Co alloys containing different amounts of the binding phase. In the figure, A stands for the pseudo-binderless alloy in the Example of the present invention while B stands for the curve showing the effect of the amount of the binding phase in the coarse size WC—Co alloys, C that in the medium size WC—Co alloys and D that in the ultrafine size WC—Co alloys.

As clear from FIG. 2, the hardness of the pseudo-binderless alloy in the present invention is positioned on the extended line of the hardness of the ultrafine material at different amounts of the binder phase. The results show that while the alloys made from coarse sized WC with smaller amounts of the binding phase still depend greatly on the characteristic properties of the binding phase due to relatively large volume of the binding phase filling the interspace between WC particles, those with WC in ultrafine size depend less on the characteristic properties of the binding phase. In this way the pseudo-binderless alloy of the present invention resides in reference to the hardness on the extended line of the ultrafine sized WC—Co alloys.

FIG. 3 shows the results of evaluation of the abrasion resistance by CCPA on the alloys of this Example, which are represented in correspondence to their content of the binder phase (where, A stands for the pseudo-binderless alloy with 99% of density and A' for that with 93% of density).

As obvious from FIG. 3, the pseudo-binderless alloys of the present invention show some 10 times to 100 times as high abrasion resistance as ordinary cemented carbides. This is due to the fact that, since abrasion takes place basically in the soft binding phase, extremely low content of the binding phase in the alloys in this Example gives extremely excellent abrasion resistance. However, in alloy A', with lower density the WC particles are not bound together by the binding phase due to the presence of pores, and so high abrasion resistance is not achieved.

FIG. 4 compares the fracture toughness of the pseudo-binderless alloys of this Example as obtained by the Vickers method with that of conventional cemented carbides. The fracture toughness ($K_{IC}$) of alloys is dependent on the thickness of the binding phase and its interface with WC. In the alloys of the present invention, which contain very minute amounts of the binding phase, the values of breaking toughness are lower than those of the conventional alloys, but due to the presence of $Co_xW_yC_z$ extensive decrease of the toughness can be prevented.

Since the cemented carbides with high strength which are obtainable by the present invention are excellent in corrosion resistance, porosity, abrasion resistance, resistance to electric discharge processing, glossiness and non-magnetism, they may be profitably used in such wide fields of cutting tools ($V_B$, $K_T$ abrasion) and abrasion resistant tools in general works as well as in the fields of works of difficult processes like W—Ni.

EFFECTS OF THE INVENTION

As described above in detail, by the addition of the specified amounts of Mo or $Mo_2C$ and VC to the mixture of WC—Co according to the present invention, the amount of Co in the powdered raw material before sintering can be reduced and at the same time the wettability of WC—Co can be augmented. As the result a cemented carbide with high hardness, high abrasion resistance, high corrosion resistance and high rigidity, which also shows excellent performance as an alloy to be used for nozzles for high pressure water flow and for tools for cutting, sliding, drawing die and others, can be obtained.

The invention also prevents the toughness of alloys from lowering by improving the wettability between the hard phase, consisting of WC as the major component, and the binding phase, and when it is applied to making pseudo-binderless alloys that contain very small amounts of Co and tend to show lowered toughness, it is effective to increase the hardness and to suppress lowering of the toughness.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A hard sintered alloy comprising more than 80% by weight of WC with less than 2 μm of average particle size, more than 0.2% by weight and less than 2% by weight of binding phase consisting of Co, and one or more of 2.0 to 7.0% by weight of Mo and $Mo_2C$, and containing in said sintered alloy $Co_xW_yC_z$ (x, y and z denote atomic ratios).

2. A hard sintered alloy comprising more than 80% by weight of WC with less than 2 μm of average particle size, more than 0.2% by weight and less than 2% by weight of binding phase consisting of Co, $W_2C$ and one or more of 2.0 to 7.0% by weight of Mo and $Mo_2C$, and containing in said sintered alloy $Co_xW_yC_z$ (x, y and z denote atomic ratios).

3. A hard sintered alloy comprising more than 80% by weight of WC with less than 2 μm of average particle size, more than 0.2% by weight and less than 2% by weight of binding phase consisting of Co, one or more of 2.0 to 7.0% by weight of Mo and $Mo_2C$, and one or more of 0.2 to 0.6% by weight of VC and chromium carbide, and containing in said sintered alloy $Co_xW_yC_z$ (x, y and z denote atomic ratios).

4. A hard sintered alloy comprising more than 80% by weight of WC with less than 2 μm of average particle size, more than 0.2% by weight and less than 2% by weight of binding phase consisting of Co, $W_2C$, one or more of 2.0 to 7.0% by weight of Mo and $Mo_2C$, and one or more of 0.2 to 0.6% by weight of VC and chromium carbide, and containing in said sintered alloy $Co_xW_yC_z$ (x, y and z denote atomic ratios).

5. A hard sintered alloy as claimed in any one of claims 1–4 wherein Co is contained in the hard sintered alloy in an amount more than 0.2% by weight and less than 1% by weight.

6. A hard sintered alloy as claimed in any one of claims 1–4 which shows higher than 14.8 g/cm$^2$ of density, higher than 2300 kg/mm$^2$ of Vickers hardness and higher than 3.0 of fracture toughness value.

7. A hard sintered alloy as claimed in any one of claims 1–4 wherein the porosity of the alloy in accordance with the ASTM Standard is less than A06, B06 and C02.

8. A method of manufacturing a hard sintered alloy which is claimed in any one of claims 1–4, comprising pressing a powdered raw material made by formulating Co, Mo or $Mo_2C$ and VC to WC powder with less than 2 μm of particle size, subjecting the pressed material to preliminary sintering and then applying hot isostatic press sintering under high pressure in an atmosphere of an inert gas.

* * * * *